United States Patent [19]

Araya et al.

[11] 4,069,754

[45] Jan. 24, 1978

[54] TRANSFER-PRINTING APPARATUS

[75] Inventors: Kenzo Araya; Takashi Hashimoto; Yoshitaka Fukui, all of Tokyo, Japan

[73] Assignee: Tanaka Seiki Co., Ltd., Tokyo, Japan

[21] Appl. No.: 618,338

[22] Filed: Oct. 1, 1975

[30] Foreign Application Priority Data

May 13, 1975 Japan ..... 50-57630

[51] Int. Cl.[2] ..... B41L 21/00; B41L 47/18, B41L/47/56

[52] U.S. Cl. ..... 101/53; 101/133.5; 101/235; 271/3

[58] Field of Search .....271/DIG. 9, 271/3; 101/52, 53, 47, 132, 132.5, 232–235, 269

[56] References Cited

U.S. PATENT DOCUMENTS

| | | | |
|---|---|---|---|
| 2,908,220 | 10/1959 | Eichenbaum et al. | 101/132.5 |
| 3,037,447 | 6/1962 | Gonzalez et al. | 101/235 |
| 3,039,385 | 6/1962 | Siegel | 101/235 |
| 3,145,653 | 8/1964 | Lake | 101/132.5 |
| 3,230,871 | 1/1966 | Kooch et al. | 101/132.5 |
| 3,245,342 | 4/1966 | Wright | 101/132.5 |
| 3,420,162 | 1/1969 | Shepherd | 101/53 |
| 3,451,336 | 6/1969 | Mignone | 101/132.5 |
| 3,547,027 | 12/1970 | Gombault | 101/53 |
| 3,640,215 | 2/1972 | Shepherd | 101/132.5 |
| 3,755,653 | 8/1973 | Venker | 271/DIG. 9 |

*Primary Examiner*—Clifford D. Crowder
*Assistant Examiner*—William Pieprz
*Attorney, Agent, or Firm*—Oblon, Fisher, Spivak, McClelland & Maier

[57] ABSTRACT

A transfer-printing process and apparatus for transfer-printing from a master card onto a work piece. The process starts by manual insertion of the master card into a gap provided between press rollers. By the insertion of the master card, the work piece is fed into a work piece path and the surface thereof is wetted during its movement along the path. The work piece thus fed and the master card sustained between the gap are registered with each other as desired and pressed for transfer-printing by the rotation of the press rollers. The work piece and the master card are then delivered to the insertion inlet of the master card.

4 Claims, 7 Drawing Figures

TRANSFER-PRINTING APPARATUS

The present invention relates to transferprinting processes and apparatuses. More particularly, it relates to transfer-printing processes wherein cards for master printing are introduced manually and the cards are taken out in the reverse direction as the cards are introduced, and transfer-printing apparatuses for working the process.

It is well known that letters or the like are printed or written on the rear surface of cards with the carbon paper and the letters thus printed reversely are pressed and transfer-printed onto the surface of a paper, and envelope or the like, which is moistened beforehand with solvent. Also apparatuses for working out such processes have been already utilized. Specifically, relatively large printing apparatuses have been used when a large amount of printing is to be made such as correspondences for many clients or for advertising. Also, it has been proposed to combine card selectors with such printing apparatuses. However, with any one of these systems, the entire volume of the system becomes too large. Further, although these systems are very useful for printing large number of work pieces, it is not so handy for printing merely several pieces.

One object of the present invention is therefore to provide a printing process consisting of rather simple steps.

Another object of the present invention is to provide a printing apparatus for working the above process.

In order to attain the first object, the printing process according to the present invention comprises in a transfer-printing process wherein a work piece to be printed is moistened with solvent and the work piece is then pressure-applied with a master printing having letters or the like to be transfer-printed onto the work piece, a first step of vertically inserting the master printing in respect of the rotation axle of a pressing roller and of sustaining it in a predetermined position; a second step of starting movement of the work piece along a path vertical to the above rotation axle in synchronism with completion of the first step, moistening the surface of the work piece with solvent during the course of movement thereof and registering the work piece with the master printing being sustained; and a third step of applying pressure to the work piece with the master printing to transfer-print and advancing them in a direction reverse to the master printing introducing direction. Since this process does not have any step of advancing the master printing, such as cards, by rollers before printing, it enables the whole process to be very simple.

In order to attain the second object, the printing apparatus according to the present invention includes: an advancing roller mechanism which takes out work pieces one by one, moistens the work piece with solvent and advances it to printing station; a transfer-printing mechanism having pressure rollers with a rotation axle parallel to that of the advancing roller mechanism which registers the work piece fed from the advancing roller mechanism with the master printing and applies pressure to them to transfer-print; a master printing position detector which generates a signal when the master printing is inserted into a predetermined position in the transfer-printing mechanism; a work piece advancing position detector provided along the path defined by the advancing roller mechanism; and means for operating the transfer-printing mechanism in a predetermined time interval after the signal is generated from the work piece advancing position detector. The transfer-printing mechanism starts its operation when the advancing roller mechanism starts to move the work piece according to the signal generated from the master printing position detector, and applies pressure to them. According to this construction, the above-mentioned process can be worked out satisfactorily. With the above apparatus, cards or the like are introduced through an inlet and envelopes or the like onto which information is to be transfer-printed are taken out to be joined together with the cards. Also, a small number of envelopes or the like can be printed rather easily.

The invention and its objects and advantages will become more apparent in the detailed description of the preferred embodiment presented below. In the detailed description of the preferred embodiment of the invention presented below, reference is made to the accompanying drawings, in which.

Figure 4:
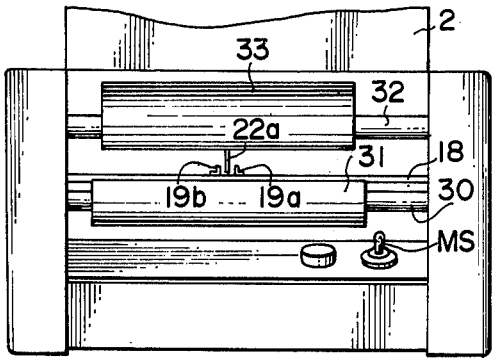

FIG. 4. is a front view of the apparatus.

Figure 5:
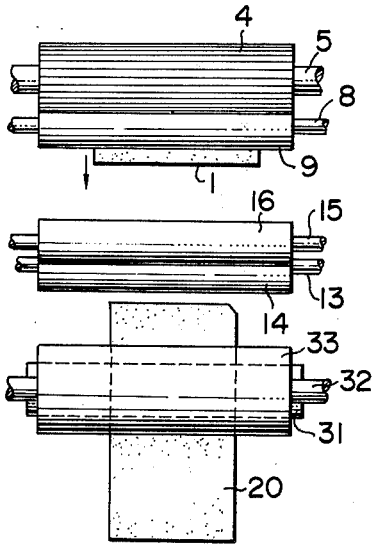

FIG. 5 shows a plan view of the rollers, the card and the paper.

Figure 6:
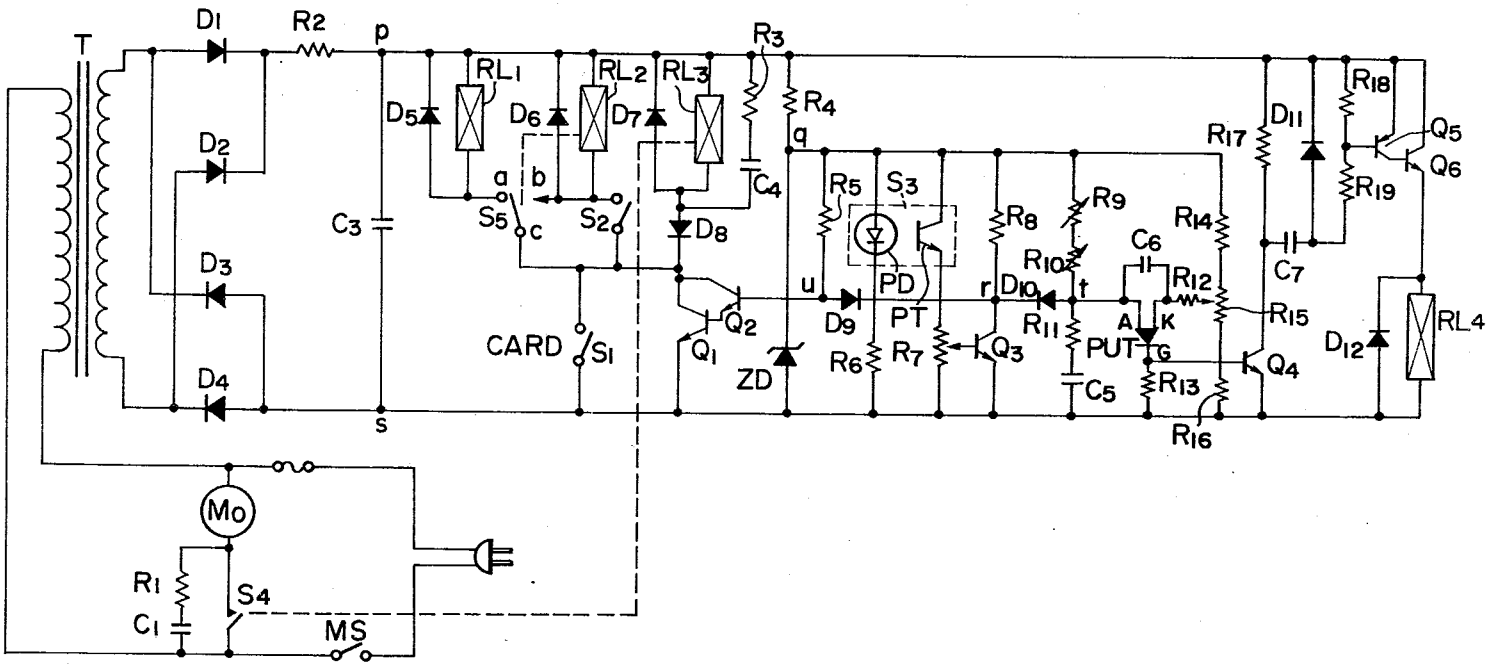

FIG. 6 shows an electric circuit for the apparatus according to the present invention.

Figure 7:
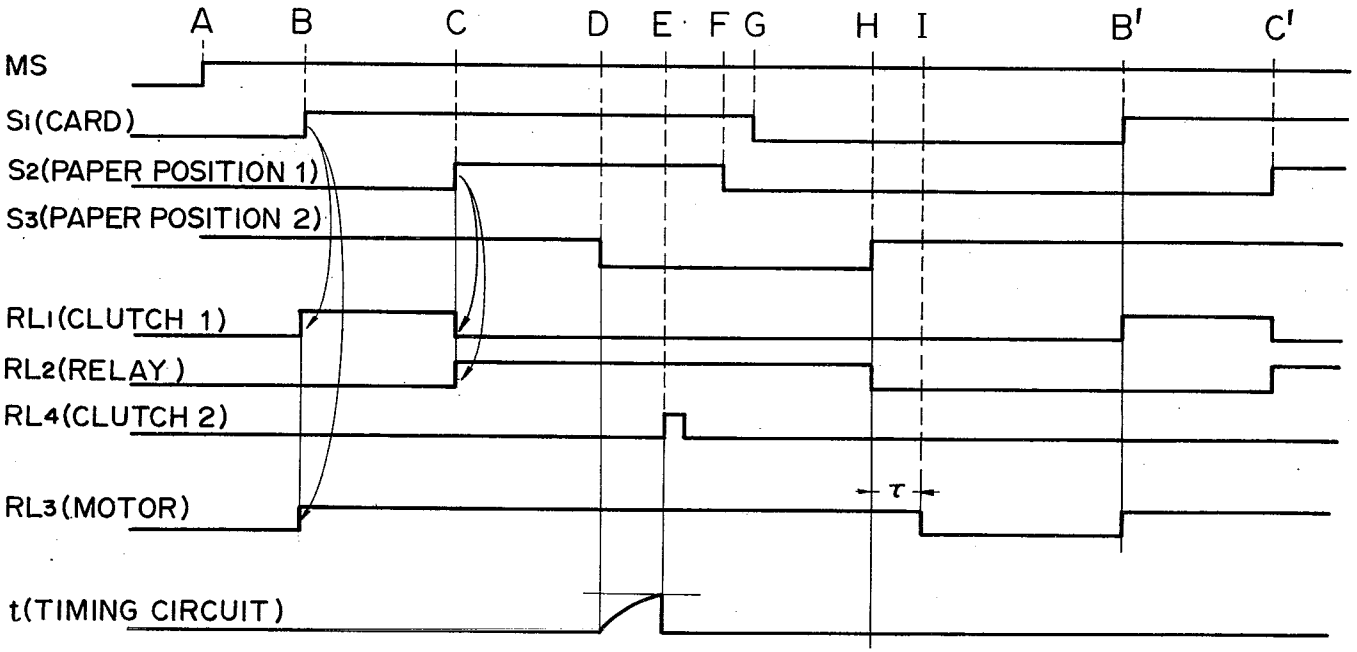

FIG. 7 is a graph explaining the operation of the apparatus and the circuit.

Figure 1:
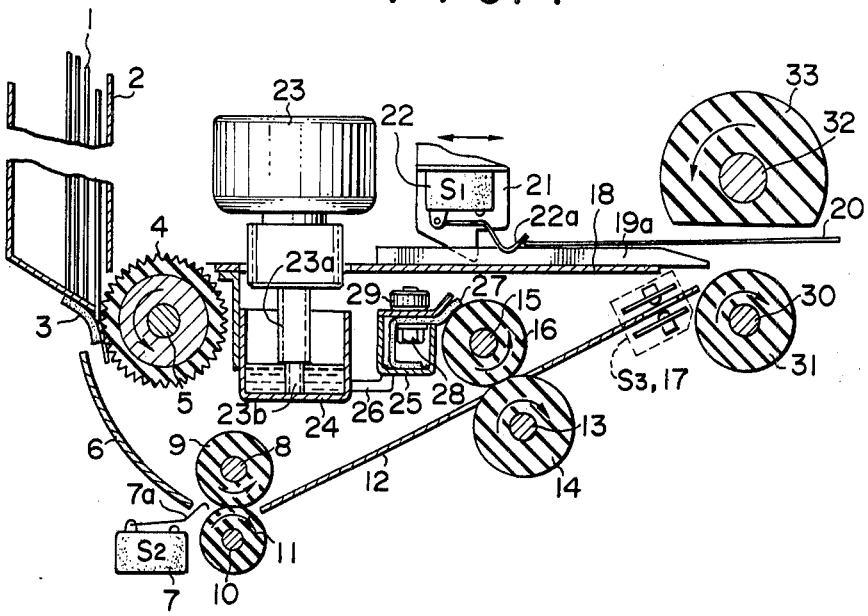
FIG. 1 shows the apparatus embodying the present invention, particularly the rollers used therein, partly shown in section.

With reference to FIG. 1, explanation will be given at first with respect to the primary rollers and the paper advancing path of the present invention. Papers 1 to be transfer-printed are held in a hopper 2. A first paper advancing roller 4 having a rubber surface around which V-shaped grooves are provided axially is mounted on an axle 5. By the anticlockwise rotation of the roller 4, the papers 1 in the hopper 2 are fed one by one downwardly. At the lower end of the hopper 2 is provided a resilient member 3, which guides the paper 1 fed from the hopper 2 so as to contact the roller 4. A pair of second paper advancing rollers 9 and 11 provided under the roller 4 are fixed respectively on axles 8 and 10. Between the rubber roller 4 and these pair of rollers 9 and 11 is a curved guide plate 6 to guide the papers from the hopper 2 to the pair of rollers 9 and 11. Further, between the rollers 9, 11 and press-printing rollers 31 and 33 about which explanation will follow later is a guide plate 12. At the center part of the guide plate 12 are prepared a pair of rollers 14 and 16 which moisten the papers and further advance the papers. The rollers 14 and 16 are fixed on axles 13 and 15, respectively. The roller 16 is a cylinder made of metal, such as brass, and the roller 14 is made of resilient material such as rubber. In the guide plate 12 is provided an opening for the rollers 14 and 16. The upper printing metal roller 33 fixed on an axle 32 and having a cylindrical surface except a partially included flat surface and the roller 31 of resilient material which is fixed on an axle 30 facing the roller 33 coact with each other in registering and pressing the paper fed from the hopper 2 already moistened with solvent along the advancing path with a card 20 having master printing thereon, so that the information printed on the card 20 is transfer-printed onto the paper. In FIG. 4, there is shown a front view of the apparatus embodying the present invention. The card 20 is inserted between the rollers 31 and 33. FIG. 5 shows the disposition of the above mentioned rollers. These rollers rotate during the time of operation of the apparatus as shown by respective arrows in FIG. 1.

Next, explanation will be given with respect to the solvent supply system of the apparatus. A tank 23 is filled with a solvent such as alcohol. A tank 24 supported by an upper base plate 18 and a tank 25 are connected through a pipe 26 so that the level of solvent in the tanks 24 and 25 is kept at the same height. At the underside of the tank 23 are provided a cylinder part 23*a* and a piston part 23*b*. When the tank 23 is supported as illustrated, the piston 23*b* of the tank 23 is pushed into the cylinder 23*a*, whereby the solvent in the tank 23 may be poured out. However, the pouring out is stopped when the liquid level of the solvent reaches the lower end of the cylinder 23*a* as illustrated. In the smaller tank 25, a water absorbing member 27 of such as felt is supported with a bolt 28 and a nut 29. One end of the felt 27 is constantly in contact with the roller 16 so that the roller 16 is always kept in a wet conditions.

Figure 3:
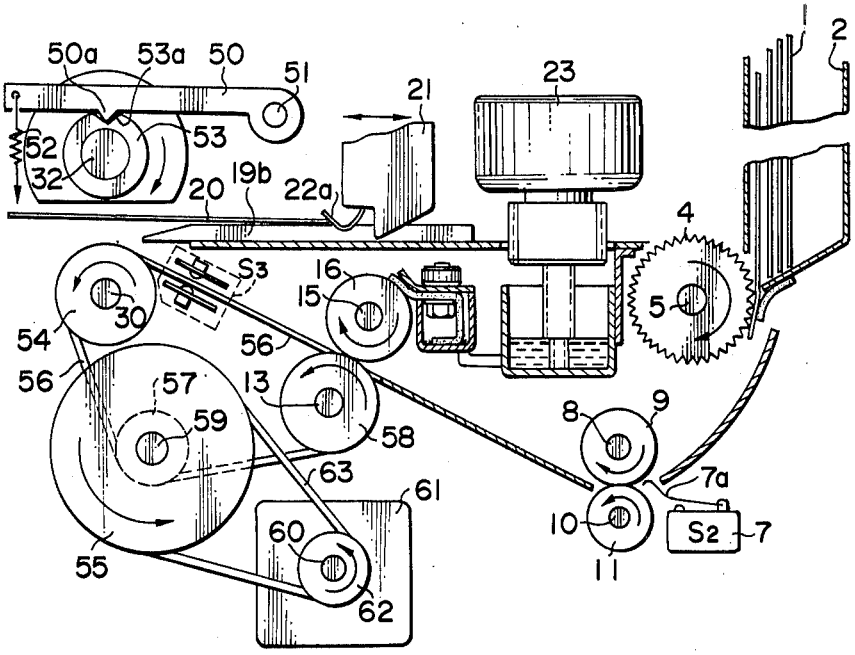

Now, explanation will be given concerning disposition of the switches of the present printing apparatus. On the base plate 18 are provided a pair of rails 19*a* and 19*b* as illustrated in FIGS. 3 and 4. Above the rails there is mounted a plate 21 which sets the card position, the plate 21 being supported so as to be moved as shown by an arrow and fixed by a certain mechanism not shown. To this plate 21 is fixed a microswitch 22, $S_1$, to detect whether the card 20 reaches a predetermined point. With the microswitch 22, $S_1$, is provided a feeler 22*a*, and when the card is inserted, the feeler 22*a* is raised and turns on the microswitch 22.

Below the curved guide plate 6 is provided a microswitch 7, $S_2$, which is a first paper position detecting switch to detect the position of the paper, the switch 7 having a feeler 7*a*.

At the end part of the paper advancing path, namely at an opening in the upper right hand of the guide plate 12, is provided a second paper position detecting switch 17 comprising a photo-coupler for detecting the paper position. The switch 17, $S_3$, comprises, as will be fully explained later, a photo-diode and a photo-transistor and assumes the OFF position while the paper intercepts light from the photo-diode.

Figure 2:
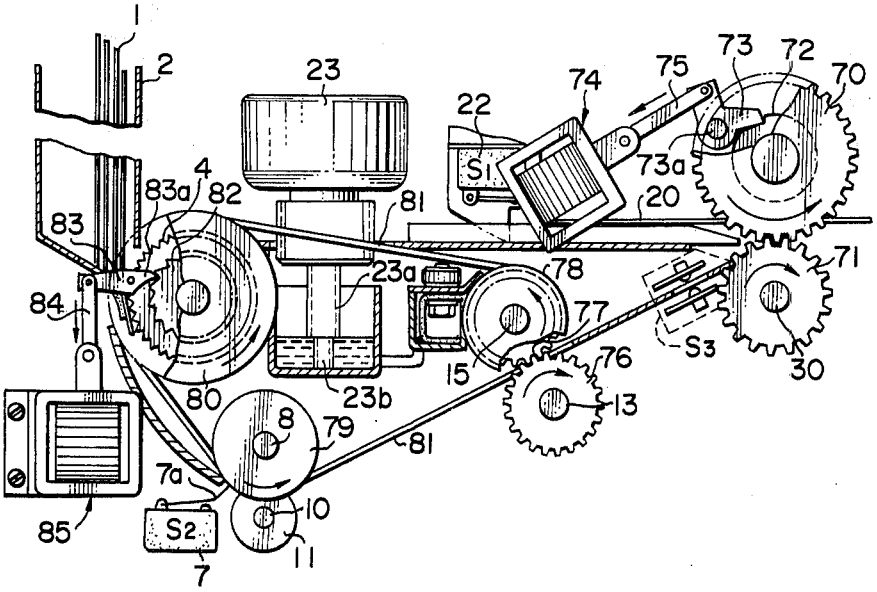
FIGS. 2 and 3 show respectively the driving means and clutch means of the apparatus, FIG. 2 showing the left side thereof and FIG. 3 showing the right side thereof. In these FIGS. 1–3, supporting frames of side walls etc. are eliminated and partial sections is used for clarification.

Explanation will now be given with respect to the driving mechanism of the above rollers with reference to FIGS. 2 and 3. The rollers are driven by a motor 61 shown in FIG. 3. Anticlockwise rotation of the motor 61 is transmitted from a pulley 62 fixed on a motor axle 60 to pulley 55 fixed on an axle 59 through a belt 63. Integrally with the pulley 55 is provided a smaller pulley 57, whose rotation is transmitted to a pulley 58 mounted on the axle 13 of the liquid roller or the third paper advancing roller and a pulley 54 provided on the axle 30 of the lower printing roller 31 through a belt 56. At the other end of the axle 13 is provided a gear 76 (FIG. 2), whose rotation is transmitted to a gear 77 on the axle 15, which is meshed with the gear 76. A further pulley 78 is provided on the axle 15. A pulley 80 is mounted on the first paper advancing roller 4 which advances the paper from the hopper 2, and a pulley 79 is provided on the axle 8 of the roller 9 which further advances the paper fed from the hopper 2. Around these pulleys 78, 79 and 80 is passed a belt 81. Thus the rotation of the axle 15 is transmitted to the rollers 4 and 9. Driving force is not transmitted to the roller 11, it rotating only following the rotation of the roller 9. On the other hand, at the other end of the axle 30 of the lower printing roller, is provided a gear 71, whose rotation is transmitted to the upper roller 33 through a gear 70.

Explanation will now be given with respect to the clutch mechanism between the printing rollers 31 and 33. The printing roller 33 is made to rotate once per one printing operation. The printing operation is further to be precisely related with the paper advancement. Since the lower roller 31 constantly rotates by the rotation of the motor, the rotating power of this roller 31 is transmitted to the gears 71 and 70, thus keeping the gear 70 rotating. According to the embodiment of the present invention, therefore, a spring clutch using a coil spring is provided between the gear 70 and the axle 32. In the event that a clutch cam 72 integrally provided with axle 32 is stopped by rotation in the anticlockwise direction shown in FIG. 2 (by an arrow) by a clutch lever 73 pivotally mounted at an axle 73*a*, the rotation of the gear 70 is not transmitted to the axle 32. As will be explained later, when pulse current is applied to a solenoid plunger 74, a connecting lever 75 of the plunger 74 is pulled back, and the lever 73 can rotate in an anticlockwise direction to allow the anticlockwise rotation of the clutch cam 72. The spring clutch then works to transmit the rotative power of the gear to the axle 32 and rotates the roller 33 in the clockwise direction as shown in FIGS. 1 and 3. On the other hand, at the end of the axle 32, appearing in FIG. 3, is provided a cam 53 having a notch part 53*a*. The cam 53, coacting with a lever 50 rotatably mounted on an axle 51 and receiving moving power in an anticlockwise direction by a spring 52, works to prevent any undesirable vibration at the time of completion of rotation of the printing roller 33. To the notch 53*a* adequate slanting is given so that when sufficient rotative power is given to the axle 32 by the above-mentioned clutch mechanism, the lever 50 is pushed away in the clockwise direction and rotates. As will be mentioned later, however, the solenoid plunger returns to its illustrated position after a short time interval, and, therefore it disengages the clutch after each rotation and, thereby, the notch 53*a* and a detent 50*a* engage each other as illustrated at the time of completion of one rotation, thus absorbing and stopping the vibration due to the clutch spring and the inertia.

Next explanation is made with respect to the clutch mechanism provided in relation to the roller 4 which feeds the papers 1 from the hopper one by one. This clutch gear includes a ratchet gear 82 and a well-known spring clutch and is controlled by a solenoid plunger 85. With energization of the solenoid plunger 85, a connecting lever 84 is drawn back downwardly, and a lever 83 rotates in the anticlockwise direction. By the then disengagement of the gear 82 from a leading top 83*a*, of the lever 83, the rotation of the pulley 80 is transmitted to the axis 5 and the roller 4. In the state illustrated in FIG. 2, the rotative power of the pulley 80 is not transmitted to the axis 5 and the roller 4. In such a state, the roller 4 rotates only by the paper feeding speed of the paper 1 by the rollers 9 and 11.

Further explanation is given to the circuit of the apparatus according to the present invention with reference to FIG. 6. A motor Mo is connected to an A.C. power circuit through a switch $S_4$ and a main switch MS. The series circuit of a resistor $R_1$ and a condenser $C_1$ which is parallel to the switch $S_4$ constitutes a protecting circuit for the switch $S_4$. The primary coil of the step-down transformer T is also connected to the A.C. power source through the switch MS. At the output of the secondary coil of the step-down transformer is connected a full-wave rectifying circuit including diodes $D_1$, $D_2$, $D_3$ and $D_4$. The output of the above full-wave rectifying circuit is smoothed by a smoothing circuit comprising a resistor $R_2$ and a condenser $C_3$. the rectified output thereof is used as a power source for a circuit to be hereinafter explained. Solenoid coils $RL_1$, $RL_2$, $RL_3$ and $RL_4$ are those of solenoid plungers or relays to be driven by the power source. The coils $RL_1$, $RL_2$, $RL_3$ and $RL_4$ are connected in parallel with protecting diodes $D_5$, $D_6$, $D_7$ and $D_{12}$, respectively. The solenoid coil $RL_1$ is for the solenoid plunger 85 (see FIG. 2) to control the clutch mechanism provided in relation to the roller 4. $RL_2$ is a coil for a relay. When the current is applied thereto, a switch $S_5$ is driven to connect *b* and *c*. $RL_3$ is also a coil for a relay. When the current is applied thereto, the switch $S_4$ for the circuit of the motor Mo assumes its OFF position. A series circuit of a resistor $R_3$ and a condenser $C_4$ which is connected in parallel to the coil $RL_3$ is provided to delay the starting of the relay. $RL_4$ is a coil for the solenoid plunger 74 which controls the clutch mechanism provided for the roller 33. A switch $S_2$ connected in series with the coil $RL_2$ corresponds to the switch 7 provided along the paper advancing path, and it is assumes its ON position while the feeler *7a* of this switch 7 is pushed together with the paper fed from the hopper 2 (see FIG. 1). The series circuit of a resistor $R_4$ and a constant voltage diode ZD connected between the plus line of the D.C. power supply and the ground voltage line is a voltage stabilizing circuit for supplying stabilized D.C. voltage and the voltage at point q is made constant. A photo-coupler $S_3$ is driven with this stabilized power source. The photo-coupler $S_3$ comprises a photo-diode PD and a photo-transistor PT, which are disposed above and under the paper advancing path facing each other as shown in FIG. 1. To the emitter of the photo-transistor PT is connected a potentiometer $R_7$. A center tap of resistor $R_7$ is connected to the base of a transistor $Q_3$. The collector of the transistor $Q_3$ is connected to point q through a resistor $R_8$. A circuit of resistors $R_9$, $R_{10}$, $R_{11}$ and a condenser $C_5$ constitutes a time constant circuit and its time constant may be controlled in certain ranges by varying the resistance of the resistor $R_9$. Namely, by rotating a knob shown in FIG. 4, the resistance may be varied. The collector of the transistor $Q_3$ (point *r*) and point *t* in the above time constant circuit are connected through a diode $D_{10}$. Between points *q* and *s* are connected resistors $R_{14}$, $R_{15}$ and $R_{16}$ constituting a voltage dividing circuit which determines the operating voltage of a programmable unijunction transistor PUT. The cathode K of the PUT is connected to the voltage dividing circuit through a resistor $R_{12}$, the anode A thereof to point *t* of the time constant circuit, and the gate *g* to a ground voltage line through a resistor $R_{13}$. A condenser $C_6$ connected between the anode and cathode of the PUT is provided to prevent erroneous operation of the PUT. To the gate G of the PUT is connected the base of a transistor $Q_4$ and to the collector of this transistor is connected a load resistor $R_{17}$ and a condenser $C_7$. The condenser $C_7$ and resistors $R_{18}$ and $R_{19}$ constitute a differential circuit. Transistors $Q_5$ and $Q_6$ are Darlington connected and to the emitter of the transistor $Q_5$ is connected the above mentioned $RL_4$. The coil $RL_3$ of the relay controlling the switch $S_4$ for the motor Mo constitutes a load for the Darlington circuit of transistors $Q_1$ and $Q_2$. The base of this transistor $Q_2$ is connected to the collector of the transistor $Q_3$, point *r* through a diode $D_9$.

The operation of the above-mentioned circuit is explained with reference to FIG. 7.

A. When the main switch MS is turned ON, there appears a rectified and smoothed voltage between points *p* and *s*, a stabilized voltage between points *q* and *s*. The switch $S_3$ (photo-coupler) and the photo-diode PD then start to emit. The photo-transistor PT receiving this emission is ON and since the transistor $Q_3$ is also ON, the voltage at its collector, point *r*, is nearly zero and the potential of points *t* and *u* is around the same low voltage. Therefore, the transistors $Q_1$ and $Q_2$ are OFF and current does not flow in the solenoid coil $RL_3$. The switch $S_4$ is OFF and the current is not supplied to the motor Mo. Since the voltage at point *t*, namely the anode voltage of PUT is low, the PUT is OFF and the transistor $Q_4$ is accordingly OFF. As a result thereof, there occurs no change in the base voltage of the transistor $Q_5$, and the coil $RL_4$ is OFF.

B. When the card is inserted and the switch $S_1$ is turned ON, $RL_1$ and $RL_3$ are energized. As a result thereof, the motor Mo starts to rotate and simultaneously the clutch works to rotate the roller 4.

C. When the paper is fed and the first switch along the paper advancing path is turned ON, the switch $S_5$ is connected to *b*, thus turning the relay $RL_1$ OFF and forming a self-holding circuit of the relay $RL_2$.

D. When the paper is advanced further and reaches the position of the switch $S_3$ and then between PD and PT, light to PT is intercepted. As a result, the base current is not supplied to the transistor $Q_3$, and the voltage at point *r* reaches that at point *q*. The diodes $D_9$ and $D_{10}$ are therefore biased in the reverse direction and the voltage at point *u* rises. The series circuit of the resistor $R_{11}$ and the condenser $C_5$ being short-circuited by the diode $D_{10}$, the transistor $Q_3$ is opened and the condenser $C_5$ starts to be charged by the resistors $R_9$, $R_{10}$ and $R_{11}$, thus raising exponentially the voltage at point *t* as shown with *t* in FIG. 7 (in this case $R_{11} << R_9 + R_{10}$).

E. When the voltage at point *t* rises so as to operate PUT, the PUT conducts, and $Q_4$ also conducts. The collector voltage thereof is differentiated and applied to the base of the transistor $Q_5$, and the transistor $Q_6$ supplies the pulse shown in FIG. 7 to the coil $RL_4$ of the one rotation clutch (Clutch number 2). With this, the printing rollers 31 and 33 start to rotate.

F. When the trailing edge of the paper passes away from the feeler *7a* of the switch $S_2$, the switch $S_2$ is turned OFF, but since the current path of $RL_2$-$S_5$-$S_1$ is still being formed with the switch $S_5$, current flows into $RL_2$.

G. By the rotation of the printing rollers 31 and 33, the card 20 and the paper is moved to right (in FIGS. 1 and 2) while being pressed. As a result, the switch $S_1$ is turned OFF. At this stage, since the base potential of the transistor $Q_2$ and the potential of point *u* have been biased, from the time of the above (D), the base the transistor $Q_2$ conducts when the switch $S_1$ is turned OFF thus providing the conducting path of $RL_2$ and $RL_3$.

H. When the trailing edge of the paper passes the switch $S_3$ position, the switch $S_3$ is turned ON. The base potential of the transistors $Q_1$ and $Q_2$, which constitute an electronic switch, falls and is turned OFF, thus rendering the relay $RL_2$ OFF.

I. After the time interval of $t$ from the above (H), the relay $RL_3$ turns off the switch $S_4$ of the motor M*o* with the condenser $C_4$ and the resistor $R_3$, and stops supplying current to the motor.

B'. When the card is inserted, the switch $S_1$ is turned ON and repeats the whole operation as above-explained.

The process according to the present invention will be explained more concretely with reference to the apparatus embodying this invention.

In the first process, the card 20 bearing therein the master printing is inserted in the direction vertical to the axles 30 and 32 of the pressing and printing rollers 31 and 33, or from the right to left in FIG. 1. Before that, the main switch MS is turned ON. The card 20 is further inserted to the left from the position shown in FIG. 1 until the leading edge thereof reaches the card position setting plate 21, and is sustained there. By the insertion of the card, the switch $S_1$ is turned ON (stage B in FIG. 7).

With the closure of the above switch $S_1$, the work piece is fed along the advancing path which is vertical to the rotation axles 30 and 32. During the advancing process, the surface of the work piece is moistened with solvent and is further advanced so as to register with the master printing, which is the second process. In other words, the paper advancing path from the hopper 2 to the printing rollers 31 and 33 is made vertical with respect to the rotation axles 30 and 32 of the above-mentioned printing rollers. In the course of the paper advancing path, the surface of the paper where the transfer-printing is to be made is moistened by the third paper advancing rollers 14 and 16 and fed to the underside of the card 20 which is sustained at a predetermined position. This second process is further explained in detail. When the first process is over, the switch $S_1$ is turned ON. As the switch $S_1$ is turned ON, current is supplied to the relay coil $RL_3$ and to the first paper advancing roller plunger coil $RL_1$ and the motor 61 rotates. As a result, the first, second and third paper advancing rollers 4, 9, 11, 14 and 16, and the lower printing roller 31 rotate. The first paper advancing roller 4 rotates while being connected to the pulley 80 by virtue of the first paper advancing roller plunger 85 and starts to feed the paper 1 downwardly. When the leading edge of the paper 1 reaches just before the second paper advancing rollers and the switch $S_2$ for the first paper position detector is turned ON, the supply of current to the first paper advancing roller plunger coil $RL_2$ is stopped, and, simultaneously, current is supplied to the relay coil $RL_2$. This stage corresponds to the stage B of FIG. 7. As a result, the first paper advancing clutch disengages and the paper 1 is further advanced to the second paper advancing rollers 9 and 11. The first paper advancing roller follows the paper drawn by the second paper advancing rollers and rotates slidingly against the pulley 80. When the paper 1 reaches the third paper advancing rollers 14 and 16, since the surface of the roller 16 is already wetted by the felt 27, the surface of the paper is moistened with solvent and is further advanced. When the leading edge of the paper reaches the upper end of the guide plate 12 and the switch $S_3$, the second paper position detecting switch is turned OFF, and the condenser $C_5$ of FIG. 6 starts to be charged (see FIG. 7, point D of the curve $t$). When the voltage thereof reaches a predetermined value, a pulse current is supplied to the upper printing roller plunger coil $RL_4$ (FIG. 7, point E of $RL_4$). As a result, the plunger 74 in FIG. 2 is energized. By the time of initiation of this energization, the paper 1 reaches the underside of the card 20 where pressing is to take place. The time of initiation of the upper printing roller 33 may be controlled by the control of the resistor $R_9$ of FIG. 6. Thus, the relative position of the card 20 and the paper of the printing stage may be controlled.

The third process comprises pressing and transfer-printing of the work piece, or the paper, and the master printing of the card, and feeding them in a reverse direction to the direction the card was introduced. This transfer-printing process starts with the rotation of the above-mentioned upper printing roller 33. At the stage E of FIG. 7, current is supplied to the upper printing roller plunger coil $RL_4$ and the upper printing roller plunger 74 is energized. Then, the clutch is actuated and the printing rollers start to rotate as shown by arrows in FIGS. 1, 2, and 3, thus pressing the paper 1 and the card 20 by the cylindrical surface of the roller 33 and then moving them in a direction reverse to the direction the card 20 was introduced, namely in the returning direction. The roller 33 stops when its one rotation is over as above mentioned. By this operation, the card switch 21, $S_1$, is turned OFF (FIG. 7, G). As the trailing edge of the printed paper passes the switch $S_3$, the switch $S_3$ is turned ON (FIG. 7, H). After a time interval $\tau$, the motor stops and terminates one cycle of printing. When the next card is inserted, these processes are repeated again.

As is clear from the above explanation, according to the present process, the direction of the card introducing path and the paper advancing path are the same, and the card and the paper after printing are removed by the rotation of printing rollers for transfer-printing. Thus, the operation is simple.

According to the apparatus of this invention, the above printing process may be achieved in a certain manner, and the whole volume of the apparatus may be constructed to be rather small. Thus the apparatus may be conveniently used in small offices. The whole volume of the apparatus is so small that it may be placed on generally used office desks.

It will be realized that in the process and apparatus heretofore explained veriations and modifications can be effected within the present invention. For example, the paper position detectors may be formed as a single detector. Also, the number of rollers and their disposition may be altered according to the size of the cards or the work pieces.

The invention has been described in detail with particular reference to a preferred embodiment thereof, but it will be understood that variations and modifications can be effected within the spirit and scope of the invention.

What is claimed is:

1. A transfer-printing apparatus including: workpiece advancing rollers which remove workpieces one by one from a workpiece hopper wherein workpieces are stacked and advance each workpiece to a printing station along a path, means for moistening each workpiece with solvent during the path of advancement of the workpieces; a transfer-printing mechanism having two cooperating rotatable press rollers with rotation axles parallel to those of the workpiece advancing rollers, a first press roller of the two press rollers having a surface consisting of a flat portion and a cylindrical pressing portion; the flat portion serving to create a gap between said first and second press rollers when the flat portion is located adjacent the second roller for inserting therethrough a master card with printed materials thereon, the cylindrical pressing portion cooperating with said second press roller to press together the workpiece and the master card to transfer-print the printed materials and to remove the master card together with the workpiece in a direction opposite to the direction of insertion of the master card; a master card postiion detector which generates a signal when the leading edge of a master card is manually inserted through the gap to a predetermined position; a workpiece position detector provided along the path for generating a signal when the leading edge of the workpiece reaches a predetermined point; a driving mechanism for driving the workpiece advancing rollers and for driving the transfer-printing mechanism for one rotation to transfer-print and to orient the first press roller flat portion adjacent the second roller to recreate said gap between the flat portion and the second press roller after completion of the transfer-printing; and a driving mechanism control circuit for controlling the driving mechanism so that the workpiece advancing rollers move the workpiece in accordance with the signal from the master card position detector and so that the transfer-printing mechanism begins operation after a predetermined time interval after the signal is generated from the workpiece position detector.

2. A transfer-printing apparatus according to claim 1 wherein the first press roller of the transfer-printing mechanism has the cylindrical press surface and a flat surface parallel to the rotation axle of the rollers to provide the gap between the second press roller until the transfer-printing mechanism begins operation.

3. A transfer-printing apparatus according to claim 1 wherein the workpiece advancing rollers comprise a first advancing roller which removes the workpieces one by one from the workpiece hopper, second advancing rollers which further advance the workpieces and third advancing rollers which apply solvent onto a surface of the workpiece, the intervals between the first and second and second and and third advancing rollers being within the length of the workpiece, respectively.

4. A transfer-printing apparatus according to claim 3 wherein the workpiece position detector comprises a first detector disposed just in front of the second advancing rollers and a second detector disposed after the third advancing rollers, and wherein the transfer-printing mechanism begins operation after the signal is generated from the second detector.

* * * * *